United States Patent [19]

Langeliers et al.

[11] 4,000,953

[45] Jan. 4, 1977

[54] CONCRETE CATCH BASIN WITH SPRING RETAINED MANHOLE COVER

[75] Inventors: Walter J. Langeliers; Roger W. Langeliers, both of Springfield, Oreg.

[73] Assignee: Concrete Curb Inlets Co., Springfield, Oreg.

[22] Filed: Mar. 22, 1976

[21] Appl. No.: 669,306

[52] U.S. Cl. ..... 404/5; 404/25; 49/465

[51] Int. Cl.[2] ..... E02D 29/12; E02D 29/14

[58] Field of Search ..... 404/2, 4, 5, 25; 52/19, 52/20, 21, 139, 140; 292/181; 49/463, 465

[56] References Cited

UNITED STATES PATENTS

| | | | |
|---|---|---|---|
| 794,661 | 6/1905 | Clark | 404/25 |
| 795,687 | 6/1905 | Cameron | 49/465 |
| 2,114,499 | 4/1938 | Maclear | 49/465 |
| 3,142,234 | 6/1964 | Maloon | 49/465 |
| 3,250,189 | 5/1966 | Peletz | 404/5 |

*Primary Examiner*—Henry S. Jaudon
*Attorney, Agent, or Firm*—Klarquist, Sparkman, Campbell, Leigh, Hall & Whinston

[57] ABSTRACT

A pre-cast concrete catch basin has a metal manhole cover removably disposed in a seat formed in its top slab. A spring biased latch retains the cover in position, the latch engaging a catch extending from the lower surface of the top slab.

5 Claims, 10 Drawing Figures

CONCRETE CATCH BASIN WITH SPRING RETAINED MANHOLE COVER

BACKGROUND OF THE INVENTION

This invention relates to a pre-cast concrete catch basin for use with storm sewers and, more particularly, to means for removably retaining a metal manhole cover in position on the catch basin.

The use of pre-cast concrete catch basins or curb inlets in connection with storm sewer systems has increased markedly due to the efficiencies inherent therein. Such catch basins can be pre-cast at locations remote from the place of installation, inventoried as necessary and trucked to the site for integration with sidewalk and curb construction. A concrete catch basin of this type is disclosed in Peletz U.S. Pat. No. 3,250,189.

Pre-cast concrete catch basins and curb inlets of the type above-described, however, have manifested problems as respects the installation and maintenance of the required manhole cover. Such must be readily installable and removable by maintenance crews without undue trouble, but must be resistant to pilferage by street gangs and mischievous juveniles.

It is thus the principal object of the present invention to provide a pre-cast concrete catch basin or curb inlet of the type described having a manhole cover easily installed, removable as required by maintenance crews without undue trouble, yet resistant to pilferage by unauthorized persons.

A further object of the present invention is to provide such a pre-cast concrete catch basin or curb inlet having manhole cover retaining means that will require a special tool to install and release the manhole cover, thereby to make the cover relatively pilfer-proof.

SUMMARY OF THE INVENTION

In accordance with the foregoing objects, the pre-cast concrete catch basin of the present invention is provided with a pair of vertical substantially parallel side walls, a rear wall connecting the side walls and a top slab integrally cast with the side walls and the rear walls. The side walls and the top slab define a first opening therebetween through which opening surface drainage is received. The side walls and the rear wall define a chamber communicating with a storm sewer, in communication with which the catch basin is mounted.

The top slab has a second opening therein and a recessed seat is disposed in the top slab around such second opening. The second opening is substantially summetrically disposed with respect to the aforementioned chamber and a manhole cover is removably disposed in the seat such that the upper surface of the manhole cover is substantially flush with the upper surface of the top slab.

Latch means are mounted on the lower surface of the manhole cover for removably retaining the manhole cover in the seat. Such latch means comprise a sleeve attached at its upper end to the lower surface of the manhole cover adjacent one edge thereof and a washer attached to the lower end of the sleeve. A rod is axially disposed within the sleeve, such rod extending outwardly of the upper and lower ends thereof and through the washer attached thereto. The rod is axially rotatable with respect to the sleeve and the washer by means engageable with the upper end thereof.

A bolt is attached to the lower end of the rod outwardly of the washer, and such bolt extends perpendicularly to the axis of the rod. A retainer is attached to the rod intermediate its ends, the retainer being received within the sleeve and being rotatable with respect thereto.

Spring means are disposed interiorly of the sleeve between the retainer and the washer. The spring means are compressible between the retainer and the washer upon a downwardly directed force being applied axially to the rod to extend the same further outwardly of the lower end of the sleeve.

Catch means extending from the lower surface of the top slab are mounted adjacent the second opening therein and adjacent the aforementioned latch means. Such catch means are adapted to engage the bolt on the rod when the latter is extended further outwardly of the lower end of the sleeve and washer and rotated with respect thereto. The spring means normally bias the bolt toward the sleeve and the washer to retain the bolt in the catch means upon the bolt being rotated into engagement therewith.

The catch means desirably comprise at least one projecting bolt anchored in the top slab and depending downwardly from the lower surface thereof. The spring means desirably comprises a coil spring disposed around the rod. The rod desirably is provided with a square cross-section, easily to be rotated by means engageable with the upper end thereof.

The invention further desirably comprises hook means attached to and depending from the manhole cover adjacent the edge opposite the edge adjacent to which the sleeve is attached. Such hook means are engageable with the lower surface of the top slab also to retain the manhole cover in the seat. Desirably, second catch means are provided extending from the lower surface of the top slab, such second catch means comprising at least one projecting bolt anchored in the top slab and depending downwardly from the lower surface thereof, the second catch means being adapted to be engaged by the hook means.

Finally, the sleeve is desirably provided with a slot therein for cleaning the same.

DESCRIPTION OF THE PREFERRED EMBODIMENT

Figure 1:
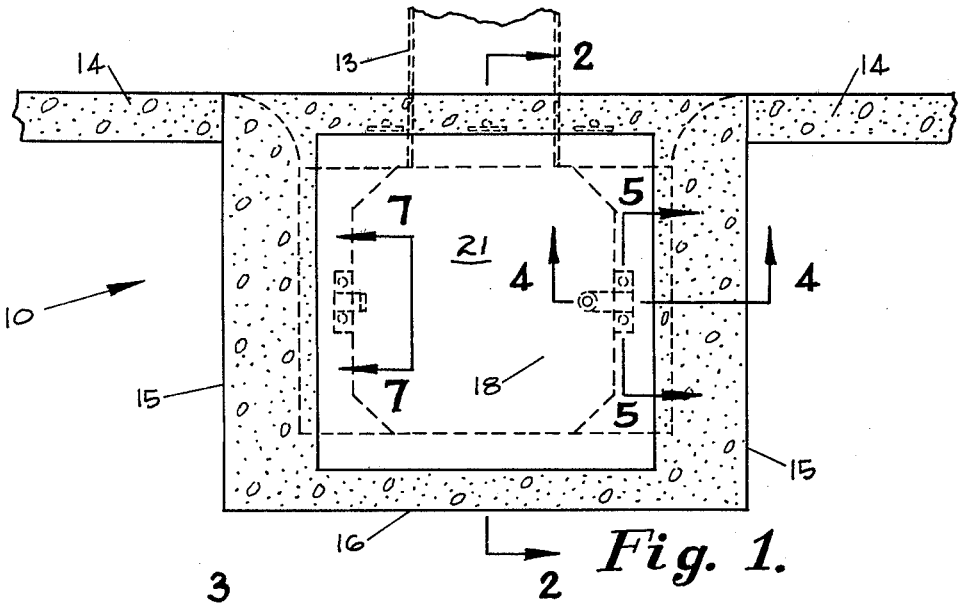
FIG. 1 is a top view of the catch basin of the present invention.
Figure 2:
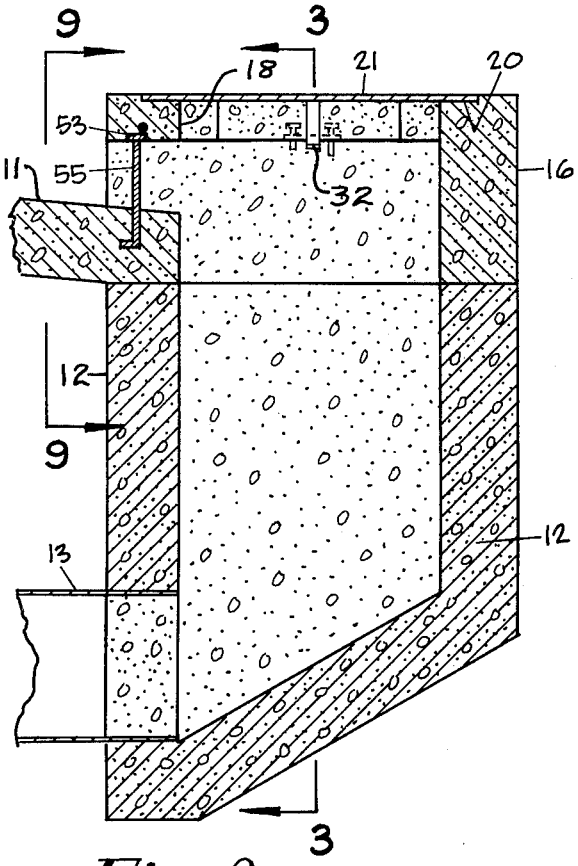
FIG. 2 is a sectional view on line 2—2 of FIG. 1.
Figure 3:
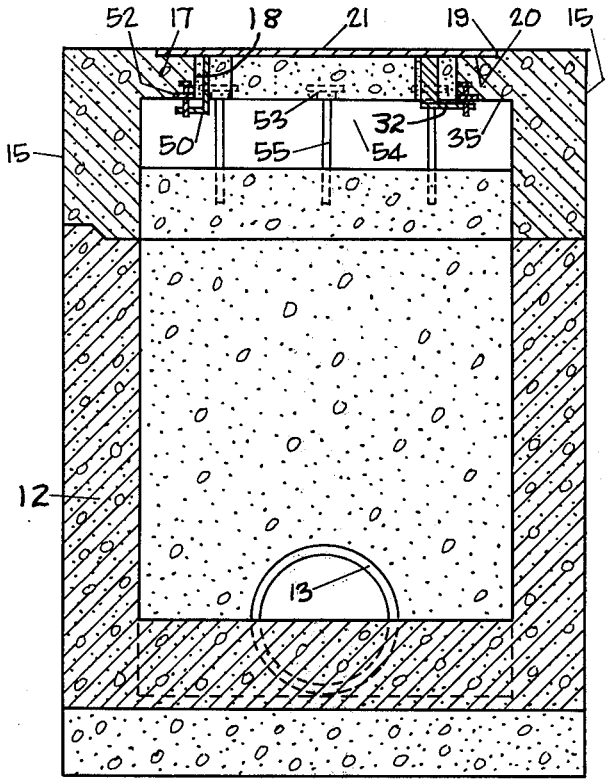
FIG. 3 is a sectional view on line 3—3 of FIG. 2.

Referring to the drawings, the pre-cast concrete catch basin of the present invention comprises a pre-cast reinforced concrete structure generally referred to by the numeral 10 which is installed above a concrete well 12 typically communicating with a storm sewer 13 or other means for disposing of surface drainage. The catch basin is of the type normally installed along a curb 14 for receiving flow from a gutter 11 of a highway or street and fits flush with the face of the curb 14 as illustrated.

The catch basin 10 comprises a monolithic structure of reinforced concrete having a pair of vertical, substantially parallel side walls 15, a rear wall 6 connecting the side walls 15 and a top slab 17 integrally cast therewith.

The top slab 17 is provided with a manhole 18 and a recessed seat 20 disposed therein around the manhole 18 and symmetrically placed as respects the basin 10. A metal manhole cover 21 is supported by the seat 20, which seat is of such depth that the upper surface of the manhole cover 21 is substantially flush with the upper surface of the top slab 17.

The manhole cover 21 is attached to the top slab 17 by a combination of hook and latch means which are attached to the cover and depend from its lower surface on opposite sides thereof. The latch means desirably comprise a sleeve 22 welded at its upper end 23 to the lower surface 24 of the manhole cover 21 adjacent one edge 19. The sleeve 22 desirably comprises a length of 1¼ inch diameter pipe of ⅛ inch wall thickness. A washer 25 is welded to the lower end 26 of the sleeve 22 as shown.

A rod 27 in the form of a ⅜ inch square bar to which is attached a retainer plug 30 welded to the rod 27 intermediate its ends is axially disposed within the sleeve 22 and extends outwardly of both the upper and lower ends 23 and 26 thereof. The rod 27 further extends through the washer 25 attached to the lower end 26 of the sleeve 22 such that the rod 27 is axially rotatable with respect to the sleeve 22 and the washer 25 by, for example, an internal socket wrench (not shown) engageable with the upper end 31 of the rod.

A bolt 32 in the form of an additional length of ⅜ inch rectangular bar stock is welded to the lower end 33 of the rod 27 outwardly of the washer 25 and extends perpendicularly to the axis of the rod 27 as shown. A 90 pound steel coil spring 34 is disposed around the rod 27 interiorly of the sleeve 22 between the retainer 30 and the washer 25. Upon an axially directed downward force being applied to the rod 27, the spring 34 is compressed between the retainer 30 and the washer 25 to extend the rod 27 further outwardly of the lower end 26 of the washer 25 for a purpose hereinafter to be described. The length of the sleeve 22 is so chosen that when the spring 34 is in its normal position, the upper surface of the bolt 32 is just below the lower surface 35 of the top slab 17. See FIG. 5. The sleeve 22 is also desirably provided with a slot in its side wall for removal of debris.

Figure 5:
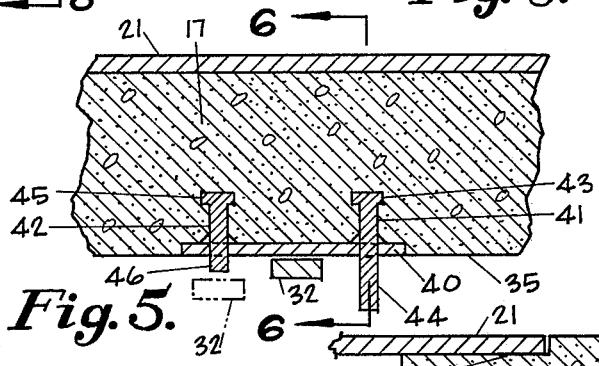
FIG. 5 is a sectional view to an enlarged scale on line 5—5 of FIG. 1.
Figure 6:
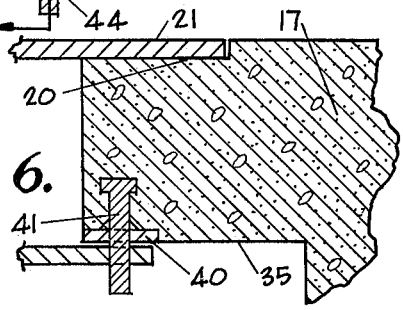
FIG. 6 is a sectional view on line 6—6 of FIG. 5.

Catch means in the form of a plate and bolt assembly are positioned in the top slab 17 of the catch basin 10 so as to be integral therewith and flush with the lower surface 35 thereof after the concrete has been poured. As shown in FIGS. 5 and 6, such assembly includes a metal plate 40 and a pair of projecting bolts 41 and 42 welded thereto. The first bolt 41 is placed in the top slab 17 such that its head 43 is disposed within the same and its lower threaded end 44 extends about an inch below the plate 40 when the same is mounted flush with the lower surface 35 of the top slab 17. The second bolt 42 is desirably positioned also with its head 45 disposed within the top slab 17, but extends a lesser distance below the plate 40. Thus, when the rod 27 is forced axially downwardly to rotate the bolt 32 with respect to the sleeve 22, the bolt 32 need only clear the lower end 46 of the smaller bolt 42 to engage the catch means (see FIG. 5), the longer extending bolt 41 serving as a stop to excessive rotation. The spring 34 thus biases the bolt 32 toward the sleeve 22 and retains the same just below the lower surface 35 of the top slab 17 and between the two bolts 41 and 42.

Figure 7:
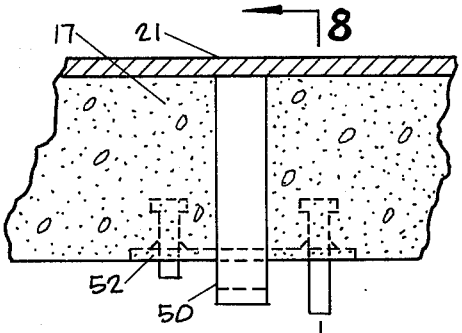
FIG. 7 is a sectional view on line 7—7 of FIG. 1.
Figure 8:
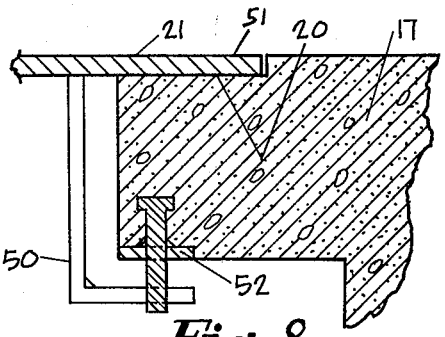
FIG. 8 is a sectional view on line 8—8 of FIG. 7.
Figure 4:
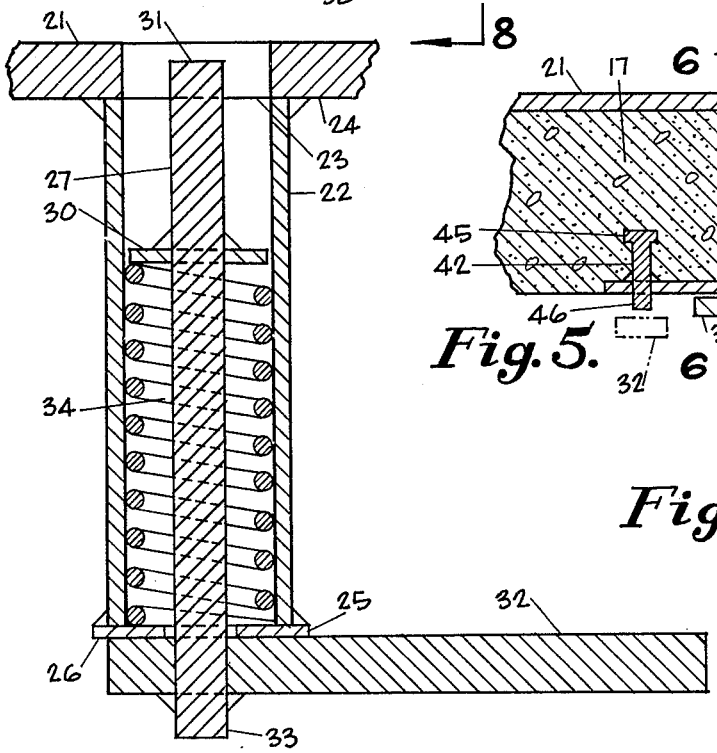
FIG. 4 is a sectional view to an enlarged scale on line 4—4 of FIG. 1.

As shown in FIGS. 7 and 8, hook means in the form of an L-shaped hook 50 is welded to and depends from the manhole cover 21 adjacent the opposite edge 51. A plate and bolt assembly 52 similar to the plate and bolt assembly 40, 41, 42, used with the latch means is integrally cast in the top slab 17 adjacent the hook 50 in like manner.

When it is desired to place the manhole cover 21 in position on the catch basin, the L-shaped hook 50 is first positioned between the bolts in the assembly 52, the rod 27 and bolt 32 being positioned such that the bolt 32 is free of the top slab 17, generally extending parallel to the side walls 15. Upon downwardly directed pressure being exerted on the top surface 31 of the rod 27 by, for example, an internal socket wrench, the bolt 32 can be rotated from its generally forwardly extending position to clear the lesser extending bolt 42 in the catch assembly, being stopped from excessive travel by the further extending bolt 41. The manhole cover 21 then is securely attached to the catch basin 10, being retained in the seat 20. Without access to a suitable internal socket wrench, the bolt 32 cannot be rotated to clear the bolts 41 and 42, thus to inhibit pilferage of the cover.

Figure 9:
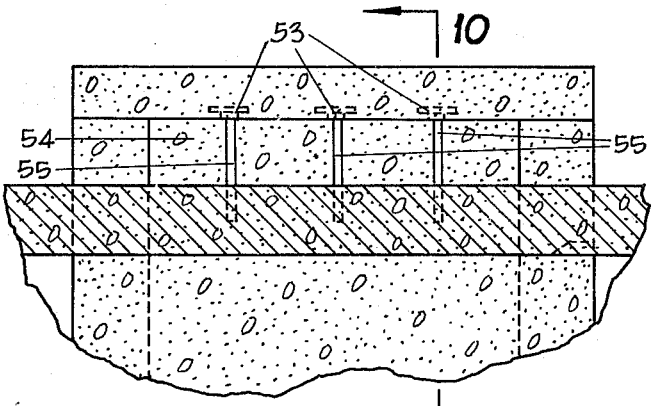
FIG. 9 is a sectional view on line 9—9 of FIG. 2.
Figure 10:
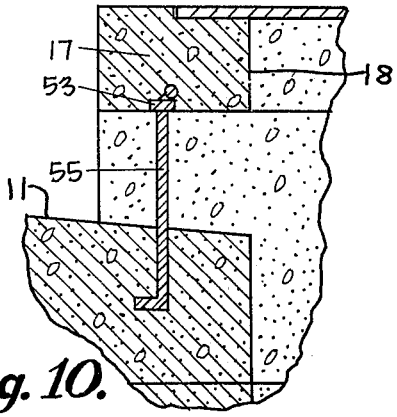
FIG. 10 is a sectional view on line 10—10 of FIG. 9.

As shown in FIGS. 9 and 10 a further feature of the present invention resides in the inclusion of nuts 53 cast integrally with the top slab 17 adjacent the opening 54, the nuts 53 being adapted to receive vertically extending threaded anchor bolts 55 for subsequent reception into the gutter 11 when such is poured. Bolts 55 form a debris blocking grid as shown. Such prevents large-sized objects from entering the catch basin, thereby to prevent blockage of the storm sewer system.

We claim:

1. In a pre-cast concrete catch basin for mounting in communication with a storm sewer and having a pair of vertical substantially parallel side walls, a rear wall connecting said side walls, a top slab integrally cast with said side walls and said rear wall, said side walls and said top slab defining therebetween a first opening through which surface drainage is received, said side walls and said rear wall defining a chamber communicating with said storm sewer, said top slab having a second opening therein, a recessed seat disposed in said top slab around said second opening, said second opening being substantially symmetrically disposed with respect to said chamber, and a manhole cover removably disposed in said seat such that the upper surface of said manhole cover is substantially flush with the upper surface of said top slab, the improvement comprising latch means mounted on the lower surface of said manhole cover for removably retaining said manhole cover in said seat, said latch means comprising a sleeve attached at its upper end to said lower surface of said manhole cover adjacent one edge thereof, a washer attached to the lower end of said sleeve, a rod axially disposed within said sleeve, said rod extending outwardly of said upper and lower ends of said sleeve and through said washer attached thereto, said rod being axially rotatable with respect to said sleeve and said washer by means engageable with the upper end thereof, a bolt attached to the lower end of said rod outwardly of said washer, said bolt extending perpendicularly to the axis of said rod, a retainer attached to said rod intermediate its ends, said retainer being received within said sleeve and being rotatable with respect thereto, and spring means disposed interiorly of said sleeve between said retainer and said washer, said spring means being compressible between said retainer and said washer upon a downwardly directed force being applied axially to said rod to extend the same further outwardly of said lower end of said sleeve; and catch means extending from the lower surface of said top slab, said catch means comprising at least one projecting bolt anchored in said top slab and extending downwardly from said lower surface thereof, said catch means being mounted adjacent said second opening therein, said catch means being adapted to engage said bolt on said rod when said rod is extended further outwardly of said lower end of said sleeve and rotated with respect to said sleeve and said washer, said spring means normally biasing said bolt on said rod toward said sleeve and said washer to retain said bolt in said catch means upon said bolt being rotated into engagement therewith.

2. The pre-cast concrete catch basin of claim 1, in which said spring means comprises a coil spring disposed around said rod.

3. The pre-cast concrete catch basin of claim 1, in which said rod has a square cross-section.

4. The pre-cast concrete catch basin of claim 1, further comprising hook means attached to and depending from said manhole cover adjacent the edge opposite said one edge thereof, said hook means being engageable with said lower surface of said top slab to retain said manhole cover in said seat.

5. The pre-cast concrete catch basin of claim 4, further comprising second catch means extending from said lower surface of said top slab, said second catch means comprising at least one projecting bolt anchored in said top slab and extending downwardly from said lower surface thereof, said last named bolt being adapted to be engaged by said hook means.

* * * * *

UNITED STATES PATENT OFFICE

CERTIFICATE OF CORRECTION

PATENT NO. : 4,000,953

DATED : January 4, 1977

INVENTOR(S) : WALTER J. LANGELIERS and ROGER W. LANGELIERS

It is certified that error appears in the above-identified patent and that said Letters Patent are hereby corrected as shown below:

Column 3, line 1; after "14" delete "for receiving flow from a gutter 11";

Column 3, line 2; after "14" insert --for receiving flow from a gutter 11--;

Column 3, line 6; "6" should be --16--.

Signed and Sealed this

Fifth Day of April 1977

[SEAL]

*Attest:*

RUTH C. MASON
*Attesting Officer*

C. MARSHALL DANN
*Commissioner of Patents and Trademarks*